US008032367B2

(12) United States Patent
Takamizawa

(10) Patent No.: US 8,032,367 B2
(45) Date of Patent: Oct. 4, 2011

(54) BIT-RATE CONVERTING APPARATUS AND METHOD THEREOF

(75) Inventor: Yuichiro Takamizawa, Tokyo (JP)

(73) Assignee: NEC Corporation, Tokyo (JP)

( * ) Notice: Subject to any disclaimer, the term of this patent is extended or adjusted under 35 U.S.C. 154(b) by 902 days.

(21) Appl. No.: 10/188,266

(22) Filed: Jul. 2, 2002

(65) Prior Publication Data

US 2003/0006916 A1 Jan. 9, 2003

(30) Foreign Application Priority Data

Jul. 4, 2001 (JP) ..... 2001-203246

(51) Int. Cl.
*G10L 19/00* (2006.01)
*G10L 19/02* (2006.01)

(52) U.S. Cl. ..... 704/229; 704/230

(58) Field of Classification Search ..... 704/203, 704/205, 230, 229; 370/433; 348/423.1; 375/240.02, 240.03
See application file for complete search history.

(56) References Cited

U.S. PATENT DOCUMENTS 4,216,354 A * 8/1980 Esteban et al. ..... 704/229
4,268,861 A * 5/1981 Schreiber et al. ..... 375/240.1
5,530,750 A * 6/1996 Akagiri ..... 704/500
5,600,645 A * 2/1997 Boyer et al. ..... 370/395.4
5,617,145 A * 4/1997 Huang et al. ..... 348/423.1
5,668,918 A 9/1997 Augenbraun et al.
5,754,235 A * 5/1998 Urano et al. ..... 375/240.03
5,838,686 A * 11/1998 Ozkan ..... 370/433
5,940,798 A * 8/1999 Houde ..... 704/271
6,018,707 A * 1/2000 Nishiguchi et al. ..... 704/222
6,047,253 A * 4/2000 Nishiguchi et al. ..... 704/207
6,134,523 A * 10/2000 Nakajima et al. ..... 704/229
6,172,629 B1 * 1/2001 Fetterman ..... 341/131
6,404,364 B1 * 6/2002 Fetterman et al. ..... 341/131
6,426,975 B1 * 7/2002 Nishi et al. ..... 375/240.13
6,662,155 B2 * 12/2003 Rotola-Pukkila et al. .... 704/228
6,757,648 B2 * 6/2004 Chen et al. ..... 704/203

(Continued)

FOREIGN PATENT DOCUMENTS

JP H03-144600 6/1991

(Continued)

OTHER PUBLICATIONS

Nagayoshi, et al., "A Study on the Rate Control Method for MPEG Transcoder Considering Drift-Error Propogation", vol. 1, pp. 960-963 (2000).

(Continued)

*Primary Examiner* — Eric Yen
(74) *Attorney, Agent, or Firm* — Scully, Scott, Murphy & Presser, P.C.

(57) ABSTRACT

A bit-rate converting apparatus and a method thereof, in which bit-rate conversion is executed by low computational complexity, are provided. The bit-rate conversion is executed in a frequency domain, and psycho-acoustic analysis is not needed by using information included in an inputted bit-stream before the bit-rate conversion is applied. With this, the computational complexity is lowered. And in order that many equal values are not contained in a frequency domain signal, which is inputted to a quantizing means, a quantized value before inverse quantizating is applied is modified, or an inverse quantized value after the inverse quantizing was applied is modified. With this, fine control for the bit-rate is made to be easy.

10 Claims, 6 Drawing Sheets

U.S. PATENT DOCUMENTS

| | | | | |
|---|---|---|---|---|
| 6,763,067 | B2 * | 7/2004 | Hurst | 375/240.03 |
| 6,765,963 | B2 * | 7/2004 | Karczewicz et al. | 375/240.03 |
| 6,826,527 | B1 * | 11/2004 | Unno | 704/223 |
| 6,944,221 | B1 * | 9/2005 | Keesman | 375/240.02 |
| 7,075,968 | B1 * | 7/2006 | Ghassemzadeh et al. | 375/130 |
| 7,095,783 | B1 * | 8/2006 | Sotheran et al. | 375/240.01 |
| 7,110,942 | B2 * | 9/2006 | Thyssen et al. | 704/222 |
| 2001/0014179 | A1 * | 8/2001 | Tan et al. | 382/240 |
| 2001/0038668 | A1 * | 11/2001 | Gatepin | 375/240.02 |

FOREIGN PATENT DOCUMENTS

| | | | |
|---|---|---|---|
| JP | H06-259094 | | 9/1994 |
| JP | 07-336684 | A * | 12/1995 |
| JP | H10-178350 | | 6/1998 |
| JP | 2000-333176 | | 11/2000 |
| JP | 2001-28731 | | 7/2001 |
| WO | WO 00/21300 | | 4/2000 |

OTHER PUBLICATIONS

"Information technology—Generic coding of moving pictures and assocated audio information", ISO/IEC 13818-7, pp. 1-89, (1997).

Nakajima, et al., "MPEG Audio Data Encryption Bit Rate Scalability", Collected Papers of the Institute of Electronics, Information and Communication, D-II, Sep. 25, 1999, vol. J82-D-II, No. 9, p. 1355-1363.

Nakajima, et al., "Study of Methods of Converting the MPEG Rate through Requantizaion", 1995 Institute of Electronics, Information and Communication—General Lecture Papers, Information System Society 2, Mar. 10, 1995, D-348, p. 74.

Hiroshi Fujiwara Editions, Multimedia Communication Research Meeting "Latest MPEG Textbook", 1st Edition, pp. 175-176.

Hiroshi Kasai et al., "Study of MPEG-2 transcoder quantization control method considering characteristics of requantization (1)-proposal of method for control of the maximum quantization parameter prevention region", Electronic Information Communications Conference (2000), p. 60.

Isamu Nagayoshi et al., "Study of MPEG-2 transcoder quantization control method considering characteristics of requantization (2)-study relating to a method of deriving best-fit quantization parameters", Electronic Information Communications Conference (2000), p. 61.

Yuichiro Takamizawa et al., "MPEG-1 Audio Layer III Development of software for changing the bit-rate", Electronic Information Communications Conference (2001), p. 235.

* cited by examiner

BIT-RATE CONVERTING APPARATUS AND METHOD THEREOF

BACKGROUND OF THE INVENTION

The present invention relates to a bit-rate converting apparatus and a method thereof, in which the bit-rate of signals such as a compressed audio signal is converted, in particular, in which the bit-rate conversion can be realized by low computational complexity.

DESCRIPTION OF THE RELATED ART

Japanese Patent Application Laid-Open No. 2001-28731 has disclosed a video apparatus and a re-encoder using in the video apparatus. FIG. 1 is a block diagram showing a structure of a part of a conventional bit-rate converting system in this patent application. As shown in FIG. 1, in this conventional bit-rate converting system, the bit-rate conversion is realized by a decoder 501, an audio and video signal processor 502, and an encoder 503.

In FIG. 1, the decoder 501 obtains an audio signal and a video signal by decoding a compressed audio bit-stream and a compressed video bit-stream. The audio and video signal processor 502 executes processes such as the conversion of the resolution of the video signal outputted from the decoder 501. The encoder 503 generates an audio bit-stream and a video bit-stream by coding the audio signal and video signal outputted from the audio and video signal processor 502 at each of a desired audio bit-rate and a desired video bit-rate. As mentioned above, at this conventional bit-rate converting system, the bit-rate conversion is executed by that the inputted bit-stream is decoded at the decoder 501 and the decoded bit-stream is coded at a desired bit-rate.

Currently, as the audio coding system, the moving picture experts group (MPEG) standard being the international standard is widely used. FIG. 2 is a block diagram showing detailed structures of the decoder 501 and the encoder 503 shown in FIG. 1. And in FIG. 2, the MPEG audio coding system is used. In this, the audio and video signal processor 502 does not work for the conversion of the bit-rate for the audio bit-stream, therefore the audio and video signal processor 502 in FIG. 1 is omitted from FIG. 2.

The details of the MPEG audio coding system are described in Information technology—Generic coding of moving pictures and associated audio information—Part7: Advanced Audio Coding (AAC), published by ISO/IEC 13818-7:1997(E). Therefore, the detailed explanation of the MPEG audio coding system is omitted.

As shown in FIG. 2, the decoder 501 provides a quantized value decoding means 601, an inverse quantizing means 602, and an inverse transforming means 603. The quantized value decoding means 601 obtains a quantized value of a frequency domain signal and side information by decoding an inputted audio bit-stream. The inverse quantizing means 602 obtains a frequency domain signal by inversely quantizing the quantized value based on quantization precision information included in the side information. The inverse transforming means 603 obtains an audio signal in a time domain by applying inverse transformation to the frequency domain signal.

The encoder 503 provides a transforming means 604, a quantizing means 605, a quantized value coding means 606, and a psycho-acoustic analyzing means 607. The transforming means 604 obtains a frequency domain signal by applying transformation to the inputted audio signal. The quantizing means 605 obtains a quantized value of the frequency domain signal by quantizing the frequency domain signal. At this quantization, the quantizing means 605 controls the quantization precision so that best sound quality can be obtained subjectively within the limited coding amount, based on the calculated result at the psycho-acoustic analyzing means 607. The psycho-acoustic analyzing means 607 is explained later in detail. The quantized value coding means 606 applies coding to the quantized value and generates a bit-stream by multiplexing a code obtained by coding the quantized value and the side information such as quantization precision information.

The psycho-acoustic analyzing means 607 analyzes either the audio signal in the time domain or the audio signal in the frequency domain, or both of the audio signals, and calculates in what degree each frequency domain signal can be perceived acoustically by the human being. The quantizing means 605, based on this calculated result, makes the quantization precision fine for the frequency domain signal being apt to perceive acoustically, and coarse for the frequency domain signal being not apt to perceive acoustically. Generally, the finer the quantization precision is, the sound quality becomes higher but the number of bits requiring for coding becomes larger. On the contrary, the coarser the quantization precision is, the number of bits requiring for coding becomes smaller but the sound quality is deteriorated. By considering these conditions, the quantization precision is decided so that the best sound quality can be obtained subjectively within the limited coding amount.

The difficulty in compressing audio signals depends on the characteristics of the audio signals. There are two kinds of audio signals, that is, audio signals that can be easily compressed and are difficult to be compressed. Therefore, generally, the psycho-acoustic analyzing means 607 also works to control the bit-rate allocation so that an excessive coding amount is not allocated to audio signals that can be easily compressed. By allocating a small amount of bit-rate for coding audio signals that can be easily compressed and a large amount of bit-rate for coding audio signals that are difficult to be compressed, without increasing the average bit-rate, the sound quality can be made to be higher.

However, at the conventional bit-rate converting system, there is a problem that high computational complexity is required. Because, the conventional bit-rate converting system provides both the decoder 501 and the encoder 503.

SUMMARY OF THE INVENTION

It is therefore an object of the present invention to provide a bit-rate converting apparatus and a method thereof, in which a bit-rate converting system can be realized by low computational complexity.

According to a first aspect of the present invention, for achieving the object mentioned above, there is provided a bit-rate converting apparatus. The bit-rate converting apparatus provides a quantized value decoding means for obtaining a first quantized value and side information by decoding an inputted bit-stream, a quantized value modifying means for outputting a modified quantized value by modifying the first quantized value, an inverse quantizing means for obtaining a frequency domain signal by inversely quantizing the modified quantized value, based on quantization precision information included in the side information, a quantizing means for obtaining a second quantized value by quantizing the frequency domain signal, and a quantized value coding means for generating a new bit-stream by multiplexing a code obtained by coding the second quantized value and the side information. And bit-rate conversion is executed in a frequency domain.

According to a second aspect of the present invention, in the first aspect, bit-rate allocation for each channel in each time period in the new bit-stream after the bit-rate conversion was applied to is decided by bit-rate allocation for each channel in each time period in the inputted bit-stream before the bit-rate conversion is applied to.

According to a third aspect of the present invention, in the first aspect, bit-rate allocation for each channel in each time period in the new bit-stream after the bit-rate conversion was applied to is decided so that the ratio of an average bit-rate in the new bit-stream to a bit-rate for each channel in each time period in the new bit-stream becomes almost equal to the ratio of an average bit-rate in the inputted bit-stream to a bit-rate for each channel in each time period in the inputted bit-stream.

According to a fourth aspect of the present invention, in the first aspect, quantization precision for each frequency domain signal is decided, based on quantization precision included in the inputted bit-stream.

According to a fifth aspect of the present invention, in the first aspect, the modification of the first quantized value at the quantized value modifying means is the addition of a random number value.

According to a sixth aspect of the present invention, in the fifth aspect, the range of the random number value is about from −0.5 to +0.5.

According to a seventh aspect of the present invention, there is provided a bit-rate converting method. The bit-rate converting method provides the steps of, obtaining a first quantized value and side information by decoding an inputted bit-stream, outputting a modified quantized value by modifying the first quantized value, obtaining a frequency domain signal by inversely quantizing the modified quantized value, based on quantization precision information included in the side information, obtaining a second quantized value by quantizing the frequency domain signal, and generating a new bit-stream by multiplexing a code obtained by coding the second quantized value and the side information. And bit-rate conversion is executed in a frequency domain.

According to an eighth aspect of the present invention, in the seventh aspect, bit-rate allocation for each channel in each time period in the new bit-stream after the bit-rate conversion was applied to is decided by bit-rate allocation for each channel in each time period in the inputted bit-stream before the bit-rate conversion is applied to.

According to a ninth aspect of the present invention, in the seventh aspect, bit-rate allocation for each channel in each time period in the new bit-stream after the bit-rate conversion was applied to is decided so that the ratio of an average bit-rate in the new bit-stream to a bit-rate for each channel in each time period in the new bit-stream becomes almost equal to the ratio of an average bit-rate in the inputted bit-stream to a bit-rate for each channel in each time period in the inputted bit-stream.

According to a tenth aspect of the present invention, in the seventh aspect, quantization precision for each frequency domain signal is decided, based on quantization precision included in the inputted bit-stream.

According to an eleventh aspect of the present invention, in the seventh aspect, the modification of the first quantized value is the addition of a random number value.

According to a twelfth aspect of the present invention, in the eleventh aspect, the range of the random number value is about from −0.5 to +0.5.

According to a thirteenth aspect of the present invention, there is provided a bit-rate converting apparatus. The bit-rate converting apparatus provides a quantized value decoding means for obtaining a first quantized value and side information by decoding an inputted bit-stream, an inverse quantizing means for obtaining a frequency domain signal by inversely quantizing the first quantized value, based on quantization precision information included in the side information, an inverse quantized value modifying means for outputting a modified frequency domain signal by modifying the frequency domain signal, a quantizing means for obtaining a second quantized value by quantizing the modified frequency domain signal, and a quantized value coding means for generating a new bit-stream by multiplexing a code obtained by coding the second quantized value and the side information. And bit-rate conversion is executed in a frequency domain.

According to a fourteenth aspect of the present invention, in the thirteenth aspect, bit-rate allocation for each channel in each time period in the new bit-stream after the bit-rate conversion was applied to is decided by bit-rate allocation for each channel in each time period in the inputted bit-stream before the bit-rate conversion is applied to.

According to a fifteenth aspect of the present invention, in the thirteenth aspect, bit-rate allocation for each channel in each time period in the new bit-stream after the bit-rate conversion was applied to is decided so that the ratio of an average bit-rate in the new bit-stream to a bit-rate for each channel in each time period in the new bit-stream becomes almost equal to the ratio of an average bit-rate in the inputted bit-stream to a bit-rate for each channel in each time period in the inputted bit-stream.

According to a sixteenth aspect of the present invention, in the thirteenth aspect, quantization precision for each frequency domain signal is decided, based on quantization precision included in the inputted bit-stream.

According to a seventeenth aspect of the present invention, in the thirteenth aspect, the modification of the frequency domain signal at the inverse quantized value modifying means is the addition of a random number value.

According to an eighteenth aspect of the present invention, in the seventeenth aspect, the range of the random number value is about from −0.5 to +0.5.

According to a nineteenth aspect of the present invention, there is provided a bit-rate converting method. The bit-rate converting method provides the steps of, obtaining a first quantized value and side information by decoding an inputted bit-stream, obtaining a frequency domain signal by inversely quantizing the first quantized value, based on quantization precision information included in the side information, outputting a modified frequency domain signal by modifying the frequency domain signal, obtaining a second quantized value by quantizing the modified frequency domain signal, and generating a new bit-stream by multiplexing a code obtained by coding the second quantized value and the side information. And bit-rate conversion is executed in a frequency domain.

According to a twentieth aspect of the present invention, in the nineteenth aspect, bit-rate allocation for each channel in each time period in the new bit-stream after the bit-rate conversion was applied to is decided by bit-rate allocation for each channel in each time period in the inputted bit-stream before the bit-rate conversion is applied to.

According to a twenty-first aspect of the present invention, in the nineteenth aspect, bit-rate allocation for each channel in each time period in the new bit-stream after the bit-rate conversion was applied to is decided so that the ratio of an average bit-rate in the new bit-stream to a bit-rate for each channel in each time period in the new bit-stream becomes almost equal to the ratio of an average bit-rate in the inputted bit-stream to a bit-rate for each channel in each time period in the inputted bit-stream.

According to a twenty-second aspect of the present invention, in the nineteenth aspect, quantization precision for each frequency domain signal is decided, based on quantization precision included in the inputted bit-stream.

According to a twenty-third aspect of the present invention, in the nineteenth aspect, the modification of the frequency domain signal is the addition of a random number value.

According to a twenty-fourth aspect of the present invention, in the twenty-third aspect, the range of the random number value is about from −0.5 to +0.5.

According to a twenty-fifth aspect of the present invention, in the first and thirteenth aspects, the bit-rate conversion is applied to the inputted bit-stream in which audio signals were compressed.

According to a twenty-sixth aspect of the present invention, in the seventh and nineteenth aspects, the bit-rate conversion is applied to the inputted bit-stream in which audio signals were compressed.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 3:
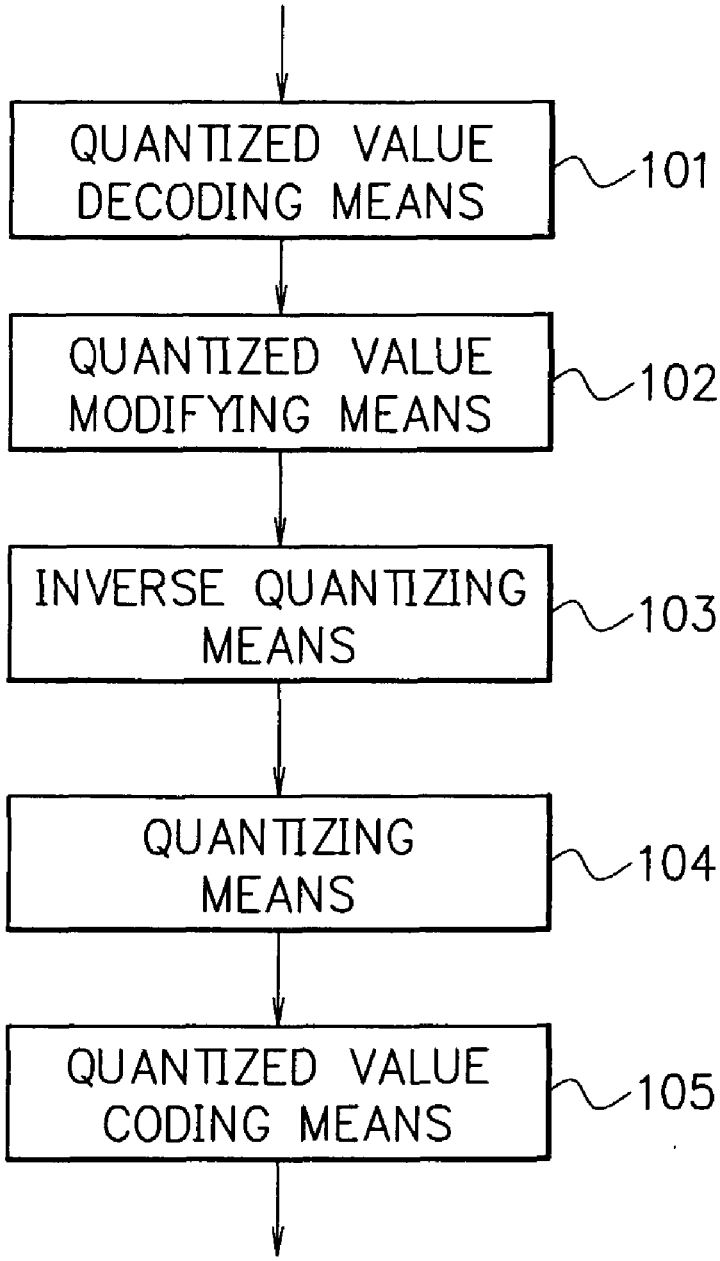
FIG. 3 is a block diagram showing a structure of a bit-rate converting system at a first embodiment of a bit-rate converting apparatus of the present invention.

Referring now to the drawings, embodiments of the present invention are explained in detail. FIG. 3 is a block diagram showing a structure of a bit-rate converting system at a first embodiment of a bit-rate converting apparatus of the present invention.

As shown in FIG. 3, the first embodiment of the bit-rate converting system in the bit-rate converting apparatus of the present invention provides a quantized value decoding means 101, a quantized value modifying means 102, an inverse quantizing means 103, a quantizing means 104, and a quantized value coding means 105. The quantized value decoding means 101 obtains a quantized value of a frequency domain signal and side information by decoding an inputted audio bit-stream. The quantized value and the side information are inputted to the quantized value modifying means 102. The quantized value modifying means 102 modifies the quantized value inputted from the quantized value decoding means 101. This modification method is explained later in detail. The modified quantized value is inputted to the inverse quantizing means 103.

The inverse quantizing means 103 obtains a frequency domain signal by inversely quantizing the modified quantized value, based on quantization precision information included in the side information. The obtained frequency domain signal is inputted to the quantizing means 104. The quantizing means 104 obtains a new quantized value of the frequency domain signal by quantizing the frequency domain signal. The obtained new quantized value is inputted to the quantized value coding means 105. The quantized value coding means 105 generates a new bit-stream by multiplexing a code obtained by coding the new quantized value and the side information.

The present invention has almost the same processes that the conventional technology has. That is, the processes, in the quantized value decoding means (the 101 in FIG. 3 and the 601 in FIG. 2), the inverse quantizing means (the 103 in FIG. 3 and the 602 in FIG. 2), the quantizing means (the 104 in FIG. 3 and the 605 in FIG. 2), and the quantized value coding means (the 105 in FIG. 3 and the 606 in FIG. 2), are almost the same in both present invention and the conventional technology.

Figure 1:
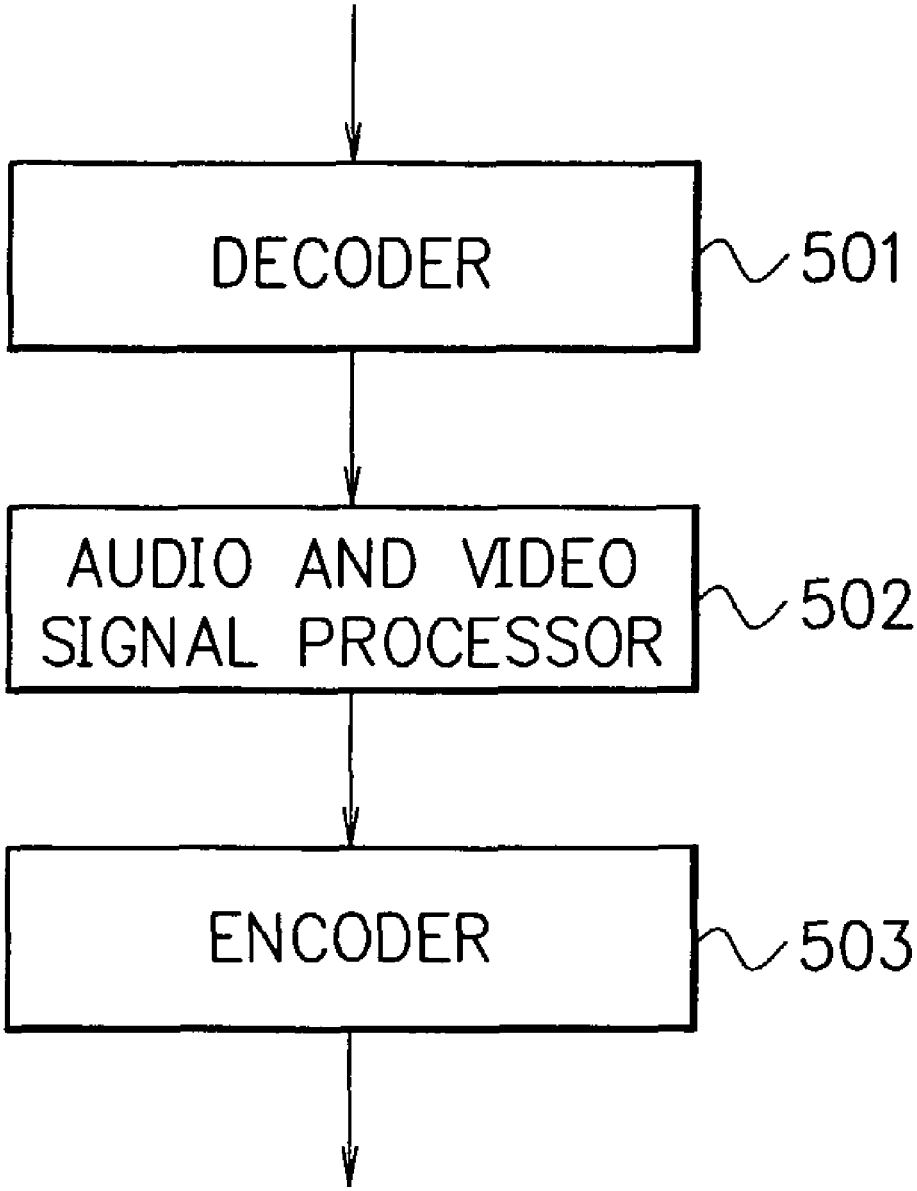
FIG. 1 is a block diagram showing a structure of a part of a conventional bit-rate converting system in Japanese Patent Application Laid-Open No. 2001-28731.
Figure 2:
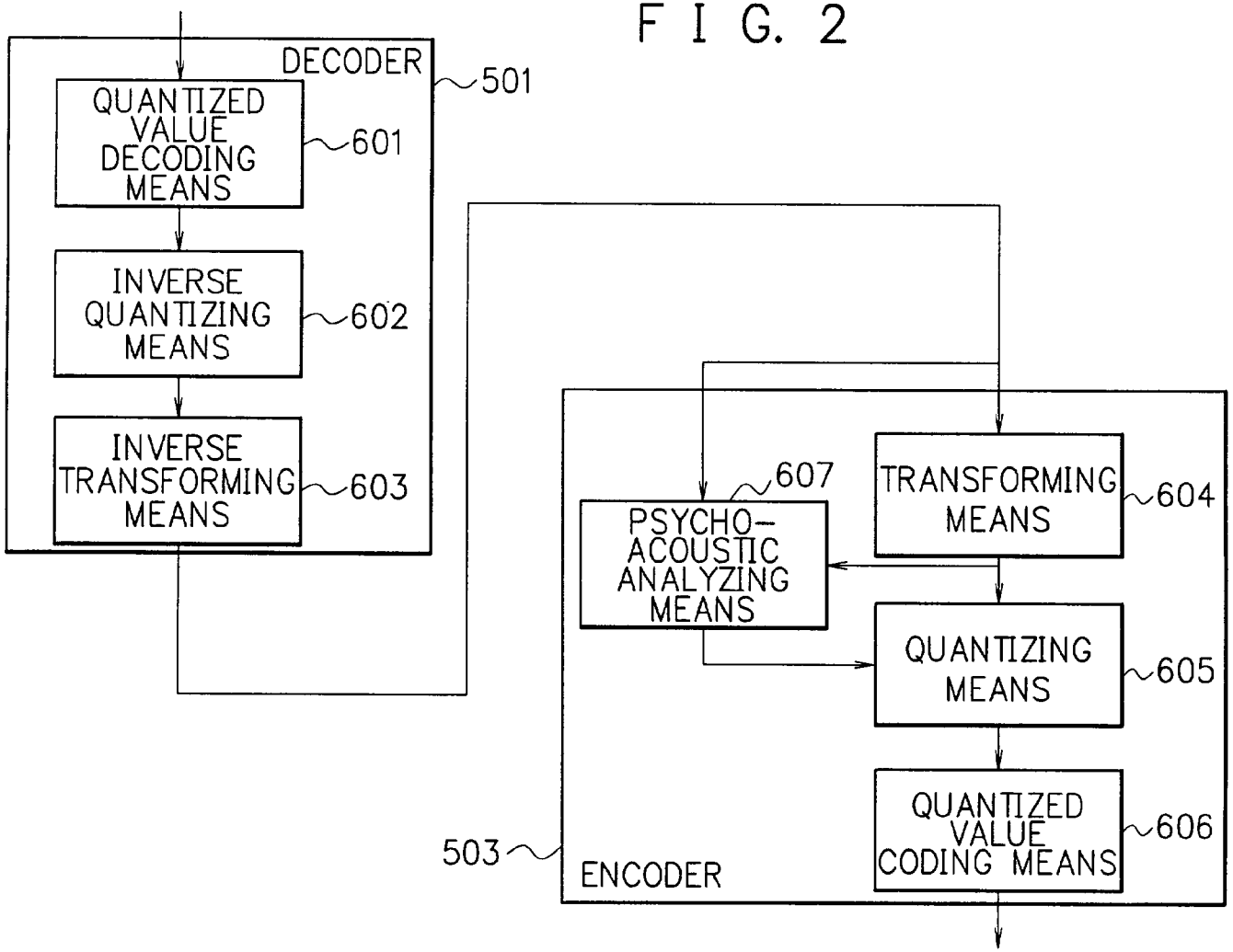
FIG. 2 is a block diagram showing detailed structures of a decoder and an encoder shown in FIG. 1.

In order to make the differences between the first embodiment of the present invention and the conventional technology clear, referring to FIGS. 2 and 3, the differences are explained in detail.

As the first difference, the inverse transforming means 603 and the transforming means 604 shown in FIG. 2 do not exist in the first embodiment of the present invention shown in FIG. 3. At the conventional technology, an audio signal in a time domain is decoded, and after this, re-coding is applied to this decoded audio signal and the conversion to a desired bit-rate is executed. However, at the first embodiment of the present invention, the bit-rate conversion is executed in the frequency domain, not in the time domain. Consequently, the inverse transforming means 603 and the transforming means 604 are not needed, and the computational complexity and the size of the apparatus, requiring for the system, can be lowered and can be made to be smaller respectively.

As the second difference, the psycho-acoustic analyzing means 607 shown in FIG. 2 does not exist in the first embodiment of the present invention. As mentioned above, at the conventional technology, the psycho-acoustic analyzing means 607 is indispensable to decide the quantization precision and the bit-rate allocation. However, at the first embodiment of the present invention, the quantization precision and the bit-rate allocation are decided at the following methods. With this, the psycho-acoustic analysis is not needed, and the computational complexity is lowered.

First, at the first embodiment of the present invention, the quantization precision is decided by using the quantization precision information, multiplexed in the bit-stream, which is a bit-stream before the bit-rate conversion is applied to and is inputted to the quantized value decoding means 101. In this inputted bit-stream, the quantization precision information, which is needed at the time when the inverse quantizing means 103 inversely quantizes the quantized value, is included as side information. This quantization precision information is named as scalefactors at the MPEG audio coding system. This quantization precision information was calculated based on the psycho-acoustic analyzed result at the time when the bit-stream, which is the bit-stream before the bit-rate conversion is applied to, was generated. And this quantization precision information can be used at the quantizing means 104 at the present invention. Therefore, at the quantizing means 104, the quantization precision information, which was obtained by that the quantized value decoding means 101 decoded the inputted bit-stream, is used.

Second, the bit-rate allocation is decided by using information included in the inputted bit-stream, which the bit-stream before the bit-rate conversion is applied to, as the same as deciding the quantization precision information. That is, at the inputted bit-stream, which is the bit-stream before the bit-rate conversion is applied to, a bit-rate, which was used to apply coding to an audio signal in a channel in a time period, can be known. By using the ratio of this bit-rate to an average coding bit-rate, the bit-rate allocation is decided.

For example, a case is studied. In this case, the average bit-rate of an inputted bit-stream, which is a bit-stream before the bit-rate conversion is applied to, is 256 kbps, and at this bit-stream, an audio signal in a channel in a time period has been coded at 384 kbps.

In case that this bit-stream is converted to a bit-rate of 128 kbps, the bit-rate for coding the audio signal in this channel in this time period is made to be 128×(384/256)=192 kbps, corresponding to the bit-rate ratio (384/256) before the bit-rate conversion is applied to. That is, a bit-rate, at the time when an audio signal in a channel in a time period is coded, is given as about C×(B/A). In this, the average bit-rate of a bit-stream before the bit-rate conversion is applied to is A, the bit-rate used at the actual coding at the bit-stream before being the bit-rate conversion is applied to is B, and the average bit-rate of the bit-stream after the bit-rate conversion was applied to is C.

As the third difference, the quantized value modifying means 102, which is not used at the conventional technology, is newly added to the first embodiment of the present invention. The quantized value modifying means 102 modifies the quantized value. As an example modifying the quantized value, a random number value being from about −0.5 to +0.5 is added to the quantized value. The effect of this quantized value modifying means 102 is that the frequency domain signal being the output from the inverse quantizing means 103 does not contain many equal values.

When the quantized value modifying means 102 does not exist, there is a case that the frequency domain signal being the output from the inverse quantizing means 103 contains many equal values. For example, in case that a stereo audio signal, whose sampling frequency is 44.1 kHz, is coded at a bit-rate of about 128 kbps, in many cases, the quantized value of the frequency domain signal being over 10 kHz becomes any of 0, +1, and −1. And since the same value of the quantization precision is used for plural quantized values at the inverse quantizing means 103, in case that a frequency band, containing many quantized values of 0, +1, and −1, is inversely quantized by the same quantization precision, the result of the inverse quantization has only the three values corresponding to 0, +1, and −1. Like this, a state, in which many equal values are contained in the frequency domain signal, occurs.

A case, in which the quantizing means 104 quantizes the frequency domain signal containing many equal values, is studied.

The quantizing means 104 quantizes the frequency domain signal by that the quantization precision information included in the side information, multiplexed in the inputted bit-stream before the bit-rate conversion is applied to, is made to be a base, and further by changing the base quantization precision information so that a desired bit-rate is obtained. Actually, at the MPEG audio coding system, the value of the scalefactor showing the quantization precision at each frequency band is used as it is, and the bit-rate is controlled by changing the global gain showing the quantization precision at all the frequency bands.

At the quantizing means 104, the quantization precision, with which a bit-rate being the closest possible to a desired bit-rate is obtained, is searched, by calculating a necessary bit-rate under the condition in which the quantization precision is changed variously. In case that the frequency domain signal contains many equal values, when the equal values are quantized by the same quantization precision, all quantized values are changed equally. Consequently, at the processes searching optimum quantization precision, even when the quantization precision is changed slightly, many quantized values are changed at the same time, and the necessary coding amount is changed largely. As a result, there is a case that the sound quality is deteriorated by not being able to obtain a bit-rate being close to the desired bit-rate.

In order to solve this problem, at the first embodiment of the present invention, the quantized value modifying means 102 is used.

The quantized value modifying means 102 prevents many quantized values from becoming an equal value, by modifying the quantized values. With this, it is avoided that many equal values are contained in the frequency domain signal outputted from the inverse quantizing means 103, and it becomes easy to obtain a bit-rate being close to a desired bit-rate. As an example modifying the quantized value at the quantized value modifying means 102, a random number value is added to the quantized value. In this case, the random number value is desirable in the range from −0.5 to +0.5.

Figure 4:
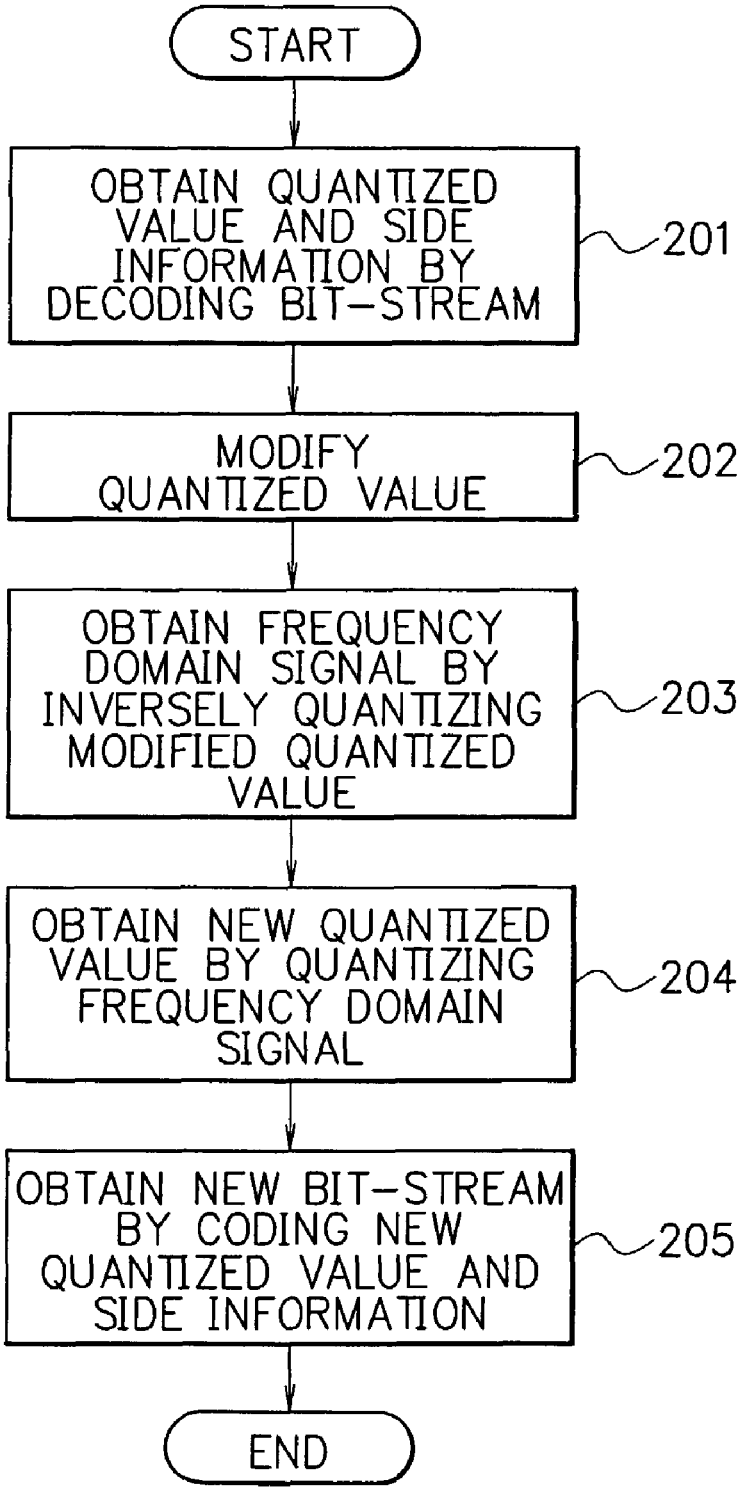
FIG. 4 is a flowchart showing operation of the bit-rate converting system at the first embodiment of the bit-rate converting apparatus of the present invention.

FIG. 4 is a flowchart showing operation of the bit-rate converting system at the first embodiment of the bit-rate converting apparatus of the present invention.

Referring to FIGS. 3 and 4, the operation of the bit-rate converting system at the first embodiment of the bit-rate converting apparatus of the present invention is explained.

An inputted bit-stream is supplied to the quantized value decoding means 101. The quantized value decoding means 101 obtains a quantized value and side information such as quantization precision by decoding the inputted bit-stream (step 201). The quantized value modifying means 102 modifies the quantized value outputted from the quantized value decoding means 101 (step 202). The inverse quantizing means 103 obtains a frequency domain signal by inversely quantizing the modified quantized value outputted from the quantized value modifying means 102, based on the quantization precision (step 203). The quantizing means 104 obtains a new quantized value by quantizing the frequency domain signal outputted from the inverse quantizing means 103 (step 204). The quantized value coding means 105 obtains a new bit-stream by multiplexing the new quantized value (a code obtained by coding the new quantized value) and the side information outputted from the quantizing means 104 (step 205).

Figure 5:
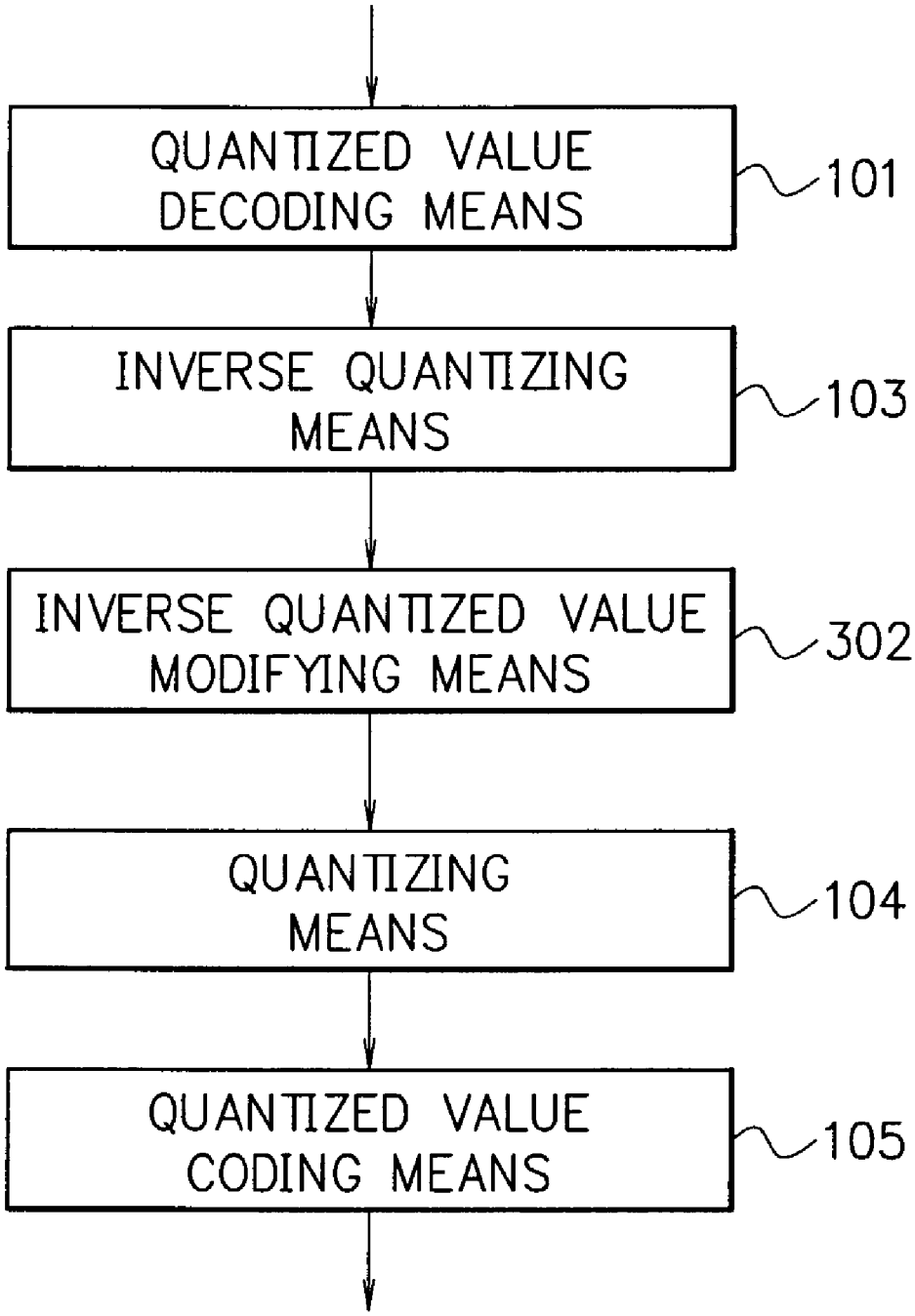
FIG. 5 is a block diagram showing a structure of a bit-rate converting system at a second embodiment of the bit-rate converting apparatus of the present invention.

Referring to the drawings, a second embodiment of the present invention is explained in detail. FIG. 5 is a block diagram showing a structure of a bit-rate converting system at the second embodiment of the bit-rate converting apparatus of the present invention.

As shown in FIG. 5, the second embodiment of the bit-rate converting system of the bit-rate converting apparatus of the present invention provides a quantized value decoding means 101, an inverse quantizing means 103, an inverse quantized value modifying means 302, a quantizing means 104, and a quantized value coding means 105. At the second embodiment, a function, which has almost the same function as the first embodiment has, has the same reference number as the first embodiment has.

At the second embodiment of the present invention, compared with the first embodiment, the inverse quantized value modifying means 302 is provided instead of the quantized value modifying means 102 at the first embodiment. At the first embodiment, it is prevented that many equal values are contained in the frequency domain signal inputting to the quantizing means 104, by modifying the quantized value at the quantized value modifying means 102. However, at the second embodiment, it is prevented that many equal values are contained in the frequency domain signal inputting to the quantizing means 104, by modifying the inverse quantized value outputted from the inverse quantizing means 103 at the inverse quantized value modifying means 302. The other processes at the second embodiment are the same as those at the first embodiment.

As the method modifying the inverse quantized value at the inverse quantized value modifying means 302, adding a random number value is used as the same as at the method modifying the quantized value at the quantized value modifying means 102 at the first embodiment.

Figure 6:
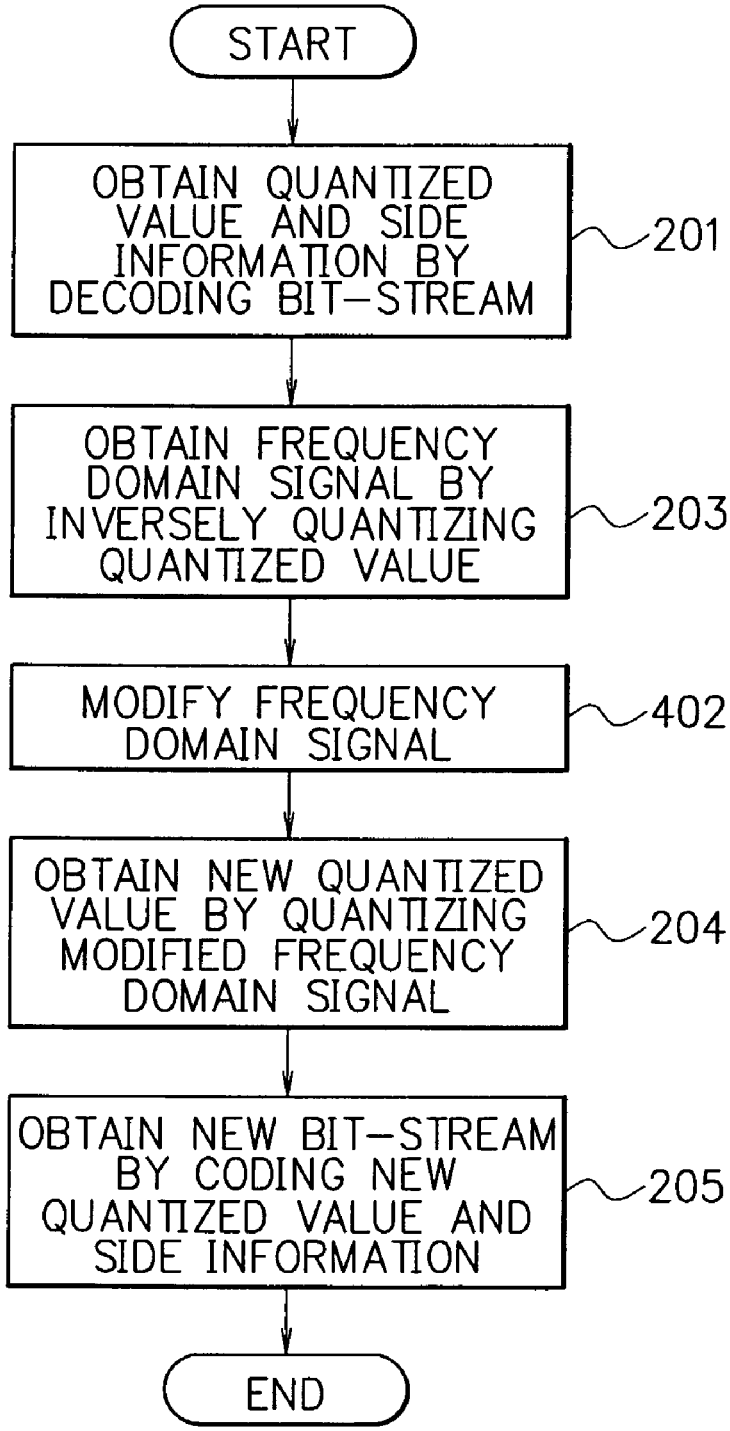
FIG. 6 is a flowchart showing operation of the bit-rate converting system at the second embodiment of the bit-rate converting apparatus of the present invention.

FIG. 6 is a flowchart showing operation of the bit-rate converting system at the second embodiment of the bit-rate converting apparatus of the present invention. In FIG. 6, a step, in which almost the same process at the first embodiment is executed, has the same step number that the first embodiment has.

Referring to FIGS. 5 and 6, the operation of the bit-rate converting system at the second embodiment of the bit-rate converting apparatus of the present invention is explained.

An inputted bit-stream is supplied to the quantized value decoding means 101. The quantized value decoding means 101 obtains a quantized value and side information such as quantization precision by decoding the inputted bit-stream (step 201). The inverse quantizing means 103 obtains a frequency domain signal by inversely quantizing the quantized value outputted from the quantized value decoding means 101, based on the quantization precision (step 203). The inverse quantized value modifying means 302 modifies the value of the frequency domain signal outputted from the inverse quantizing means 103 (step 402). The quantizing means 104 obtains a new quantized value by quantizing the modified frequency domain signal outputted from the inverse quantized value modifying means 302 (step 204). The quantized value coding means 105 obtains a new bit-stream by multiplexing the new quantized value (a code obtained by coding the new quantized value) and the side information outputted from the quantizing means 104 (step 205).

As mentioned above, according to the first embodiment of the present invention, the inverse transforming means, the transforming means, and the psycho-acoustic analyzing means, which were used at the conventional technology, are not needed by executing the bit-rate conversion in the frequency domain. In case that many equal values are contained in the frequency domain signal, the necessary coding amount changes largely and the sound quality is deteriorated. In order to solve this problem, the bit-rate conversion is executed in the frequency domain by modifying the quantized value before being executed inverse quantizing. That is, the quantized value modifying means is provided.

According to the second embodiment of the present invention, in order to solve the problem mentioned above, the inverse quantized value modifying means is provided, instead of the quantized value modifying means at the first embodiment.

By disposing the quantized value modifying means or the inverse quantized value modifying means, a state, in which many equal values are contained in the frequency domain signal, can be prevented. With this, a desired bit-rate can be obtained easily.

The first and second embodiments of the present invention can be applied to the MPEG-1 Audio Layer III standard and the MPEG-2 AAC standard being the international standard audio coding system.

As mentioned above, according to the present invention, the inverse transforming means, the transforming means, and the psycho-acoustic analyzing means, which were used at the conventional technology, are not needed. Consequently, the bit-rate conversion can be realized by low computational complexity.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A bit-rate converting apparatus, comprising:

a quantized value decoding means for obtaining a first quantized value and side information by decoding an inputted bit-stream having said first quantized value obtained by quantizing a frequency domain signal;

a quantized value modifying means for outputting a modified quantized value obtained by adding a number to said first quantized value;

an inverse quantizing means for obtaining a frequency domain signal by inversely quantizing said modified quantized value, based on quantization precision information included in said side information;

a quantizing means for obtaining a second quantized value by quantizing said frequency domain signal obtained by inversely quantizing said modified quantized value; and a quantized value coding means for generating a new bit-stream by multiplexing a code obtained by coding said second quantized value and said side information, wherein said number added to said first quantized value is selected so that said second quantized values having different values are obtained from said first quantized values having same values, and wherein said quantizing means is controlled so that the bit-rate of said new bit-stream is a target bit-rate.

2. A bit-rate converting apparatus in accordance with claim 1, wherein: bit-rate allocation for each channel in each time period in said new bit-stream after said bit-rate conversion was applied is decided by bit-rate allocation for each channel in each time period in said inputted bit-stream before said bit-rate conversion is applied.

3. A bit-rate converting apparatus in accordance with claim 1, wherein: bit-rate allocation for each channel in each time period in said new bit-stream after said bit-rate conversion was applied is decided so that the ratio of an average bit-rate in said new bit-stream to a bit-rate for each channel in each time period in said new bit-stream becomes almost equal to the ratio of an average bit-rate in said inputted bit-stream to a bit-rate for each channel in each time period in said inputted bit-stream.

4. A bit-rate converting apparatus in accordance with claim 1, wherein: quantization precision for each frequency domain signal is decided, based on quantization precision included in said inputted bit-stream.

5. A bit-rate converting apparatus in accordance with claim 1, wherein: the range of said number value is about from −0.5 to +0.5.

6. A bit-rate converting method comprising the steps of:

obtaining a first quantized value and side information by decoding an inputted bit-stream having said first quantized value obtained by quantizing a frequency domain signal;

outputting a modified quantized value obtained by adding a number to said first quantized value;

obtaining a frequency domain signal by inversely quantizing said modified quantized value, based on quantization precision information included in said side information;

obtaining a second quantized value by quantizing said frequency domain signal obtained by inversely quantizing said modified quantized value; and generating a new bit-stream by multiplexing a code obtained by coding said second quantized value and said side information, wherein said number added to said first quantized value is selected so that said second quantized values having different values are obtained from said first quantized values having same values, and wherein said step of obtaining a second quantized value is controlled so that the bit-rate of said new bit-stream is a target bit-rate.

7. A bit-rate converting method in accordance with claim 6, wherein: bit-rate allocation for each channel in each time period in said new bit-stream after said bit-rate conversion was applied is decided by bit-rate allocation for each channel in each time period in said inputted bit-stream before said bit-rate conversion is applied.

8. A bit-rate converting method in accordance with claim 6, wherein: bit-rate allocation for each channel in each time period in said new bit-stream after said bit-rate conversion was applied is decided so that the ratio of an average bit-rate in said new bit-stream to a bit-rate for each channel in each time period in said new bit-stream becomes almost equal to the ratio of an average bit-rate in said inputted bit-stream to a bit-rate for each channel in each time period in said inputted bit-stream.

9. A bit-rate converting method in accordance with claim 6, wherein: quantization precision for each frequency domain signal is decided, based on quantization precision included in said inputted bit-stream.

10. A bit-rate converting method in accordance with claim 6, wherein: the range of said number value is about from −0.5 to +0.5.

* * * * *